US009267766B2

(12) United States Patent
Serpeault et al.

(10) Patent No.: US 9,267,766 B2
(45) Date of Patent: Feb. 23, 2016

(54) ARMOURED VENTILATION GRILLE

(71) Applicant: NEXTER SYSTEMS, Roanne (FR)

(72) Inventors: Jérôme Serpeault, St Cyr l'école (FR); Vincent Desormiere, Roanne (FR); Daniel Vallee, Guyancourt (FR)

(73) Assignee: NEXTER SYSTEMS, Roanne (FR)

( * ) Notice: Subject to any disclaimer, the term of this patent is extended or adjusted under 35 U.S.C. 154(b) by 0 days.

(21) Appl. No.: 14/400,861

(22) PCT Filed: Apr. 30, 2013

(86) PCT No.: PCT/FR2013/050958

§ 371 (c)(1),
(2) Date: Nov. 13, 2014

(87) PCT Pub. No.: WO2013/171397

PCT Pub. Date: Nov. 21, 2013

(65) Prior Publication Data

US 2015/0128793 A1 May 14, 2015

(30) Foreign Application Priority Data

May 14, 2012 (FR) ..... 12 01402

(51) Int. Cl.
*F41H 7/04* (2006.01)
*F41H 7/03* (2006.01)
*F41H 5/04* (2006.01)

(52) U.S. Cl.
CPC ..... *F41H 7/048* (2013.01); *F41H 5/045* (2013.01); *F41H 7/035* (2013.01)

(58) Field of Classification Search
CPC ..... F41H 7/035; F41H 7/048; F41H 7/02; F41H 5/045
USPC ..... 89/36.07, 36.08, 930
See application file for complete search history.

(56) References Cited

U.S. PATENT DOCUMENTS

| | | | | |
|---|---|---|---|---|
| 4,005,662 | A * | 2/1977 | Kohn et al. | 109/16 |
| 4,325,283 | A | 4/1982 | Bemiss | |
| 5,753,847 | A * | 5/1998 | Middione et al. | 89/36.08 |
| 5,880,394 | A * | 3/1999 | Kim | 89/36.02 |
| 6,086,122 | A * | 7/2000 | Dieterich et al. | 293/115 |
| 6,405,630 | B1 | 6/2002 | Gonzalez | |

FOREIGN PATENT DOCUMENTS

FR 2 953 921 A1 6/2011

OTHER PUBLICATIONS

Preliminary Search Report issued in French Patent Application No. 1201402 dated Jan. 15, 2013 (with translation).
International Search Report issued in International Patent Application No. PCT/FR2013/050958 dated Jul. 9, 2013 (with translation).
Written Opinion issued in International Patent Application No. PCT/FR2013/050958 dated Jul. 9, 2013 (with translation).

* cited by examiner

*Primary Examiner* — Stephen M Johnson
(74) *Attorney, Agent, or Firm* — Oliff PLC

(57) ABSTRACT

The invention relates to an armored ventilation grille for an opening, the grille including an outer side to be exposed to a projectile shot and an inner side to be applied to the opening, the grille including a plurality of parallel bars, the bars having a V-shaped cross-section, each limb of the V being made of of a blade, the blades being arranged in chevrons in order to form baffles such that at least one blade is located in the trajectory of the projectile shot whatever the incidence may be. The grille according to the invention wherein the outer blades is made an armored material while the inner blades made of a ductile material, the blades all being fixed to transverse members in the bearing ranges in such a way that they can be disassembled.

6 Claims, 4 Drawing Sheets

ARMOURED VENTILATION GRILLE

BACKGROUND

The technical field of the invention is that of ballistic protection grilles for protecting openings such as vents.

Military vehicles or other infrastructures potentially subjected to projectile firings or fragment projections comprise openings allowing ventilation. Thus, the radiators of the vehicles or the air-conditioning heat exchangers are vulnerable areas, the protection of which by louvered grilles is known.

As described in U.S. Pat. No. 4,325,283, these grilles comprise parallel bars having a V-shaped section arranged so as to form baffles which do not allow the passage of a projectile without hitting one of the bars, but do allow an air flow to pass.

Upon firing against this type of device, the projectile hitting a bar is fragmented into several pieces which still have a such kinetic energy that they ricochet off the baffles and damage the elements protected by the grille.

SUMMARY

The invention proposes to solve this problem of stopping the projectile fragments.

Advantageously, the invention allows to lighten the grille and make it repairable and with a changeable protection level.

Thus, the invention relates to an armoured ventilation grille for an opening, said grille comprising an outer side intended to be exposed to a projectile firing and an inner side intended to be applied on the opening, said grille comprising a plurality of bars parallel to each other, the bars having a V-shaped section, each arm of the V being constituted by a blade, said blades being arranged in chevrons in order to form baffles such that at least one blade is on the trajectory of the projectile firing regardless of its incidence, each bar comprising a so-called outer blade and a so-called inner blade, the outer blades forming the outer side of the grille and the inner blades forming the inner side of the grille, said grille being characterized in that the outer blades are made of an armour material while the inner blades are made of a ductile material, the blades being all removably fixed to transverse spars at bearing surfaces.

According to an embodiment of the invention, the outer blades are made of armour steel.

According to an embodiment of the invention, the inner blades are made of aluminum.

Advantageously, the inner blades have a width at least equal to the width of a channel formed by two consecutive outer blades.

Advantageously, the outer blades are inclined at 45 degrees with respect to a plane of the grille defined by the outer edges of the outer blades.

Advantageously, the inner blades are perpendicular to the outer blades.

BRIEF DESCRIPTION OF THE DRAWINGS

The invention will be better understood upon reading the following description, description made with reference to the appended drawings, in which.

DETAILED DESCRIPTION OF EMBODIMENTS

Figure 1:
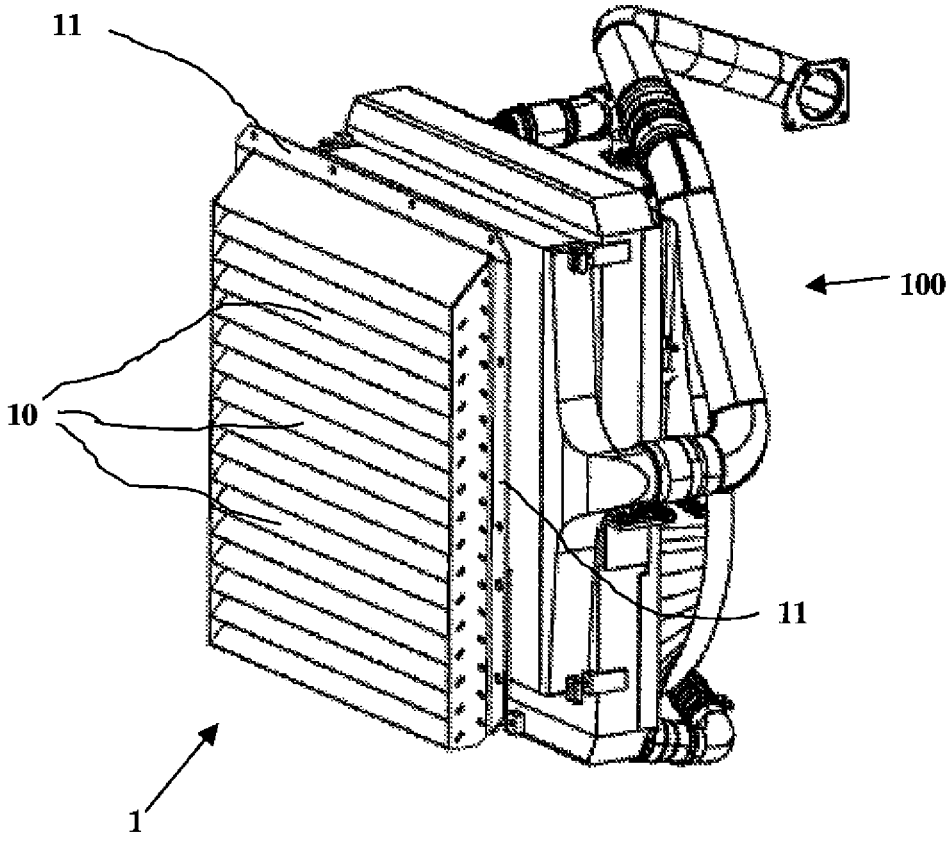
FIG. 1 shows a three-quarter view of a military vehicle's radiator protected by a grille according to the invention.

According to FIG. 1, a vehicle (not shown) comprises a radiator 100. The radiator 100 has an outer face arranged facing an opening which allows the passage of the cooling air. It comprises, pressed against its outer face, a ballistic protection grille 1, which is here vertically arranged and which hides the opening and completely covers the radiator. The grille 1 comprises a series of bars 10 horizontal and parallel to each other. The grille 1 is secured to a frame 11 which allows to secure the grille 1 to the radiator 100 or to a member of the structure of the vehicle.

Figure 2:
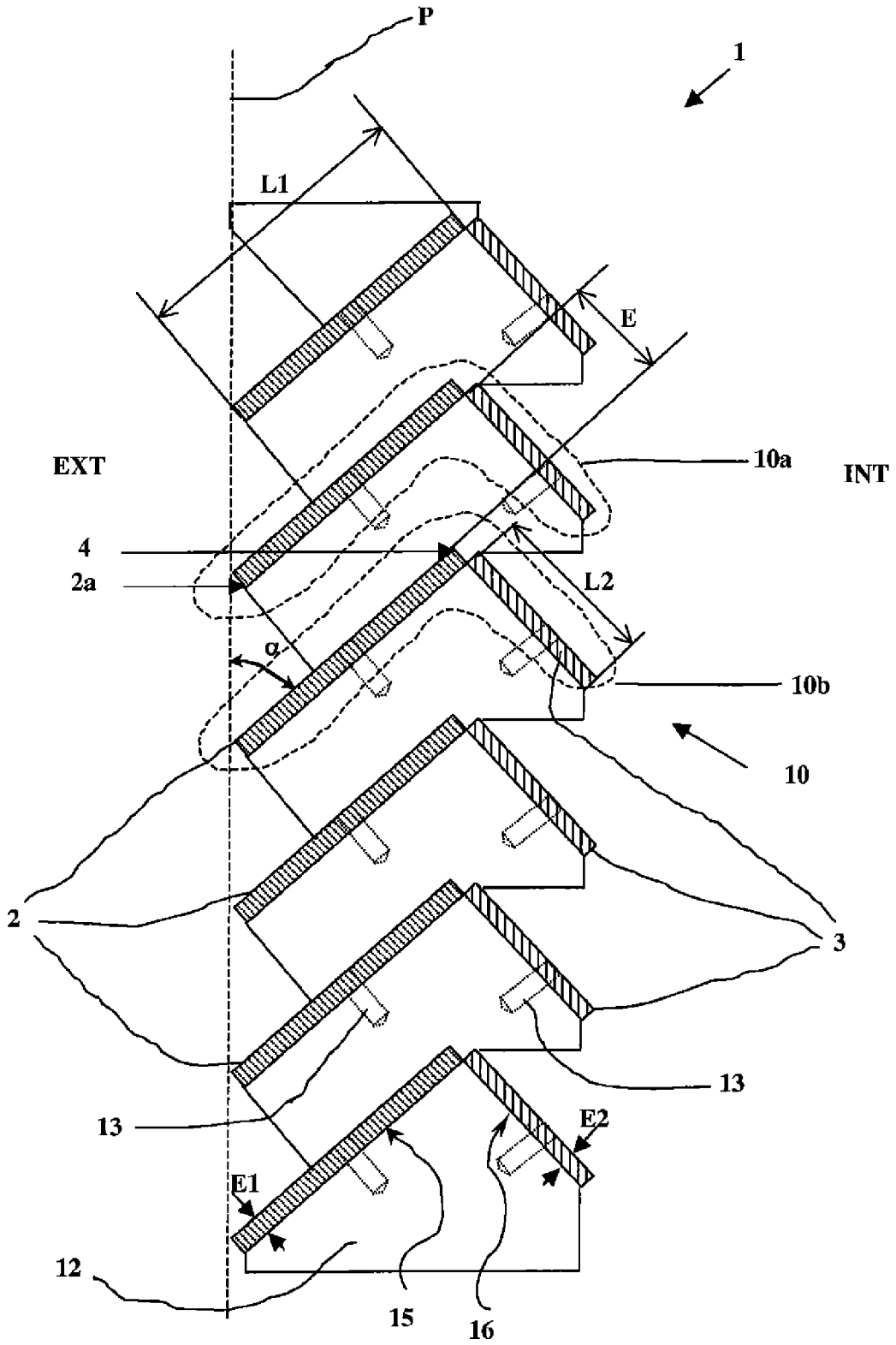
FIG. 2 shows a cross-sectional view of a grille according to the invention.

According to FIG. 2, each bar 10 has an inverted V-shaped section, each arm of the V is constituted by a blade shown in a cross-sectional view in the figure.

The bars 10 are arranged on top of each other, forming superimposed chevrons.

The grille 1 comprises an outer side EXT intended to be exposed to projectile firings and an inner side INT intended to be applied on the radiator and thus to hide the opening. Each bar 10 comprises a so-called outer blade 2 and a so-called inner blade 3, the outer blades 2 forming the outer side EXT of the grille 1 and the inner blades 3 forming the inner side INT of the grille.

Figure 3:
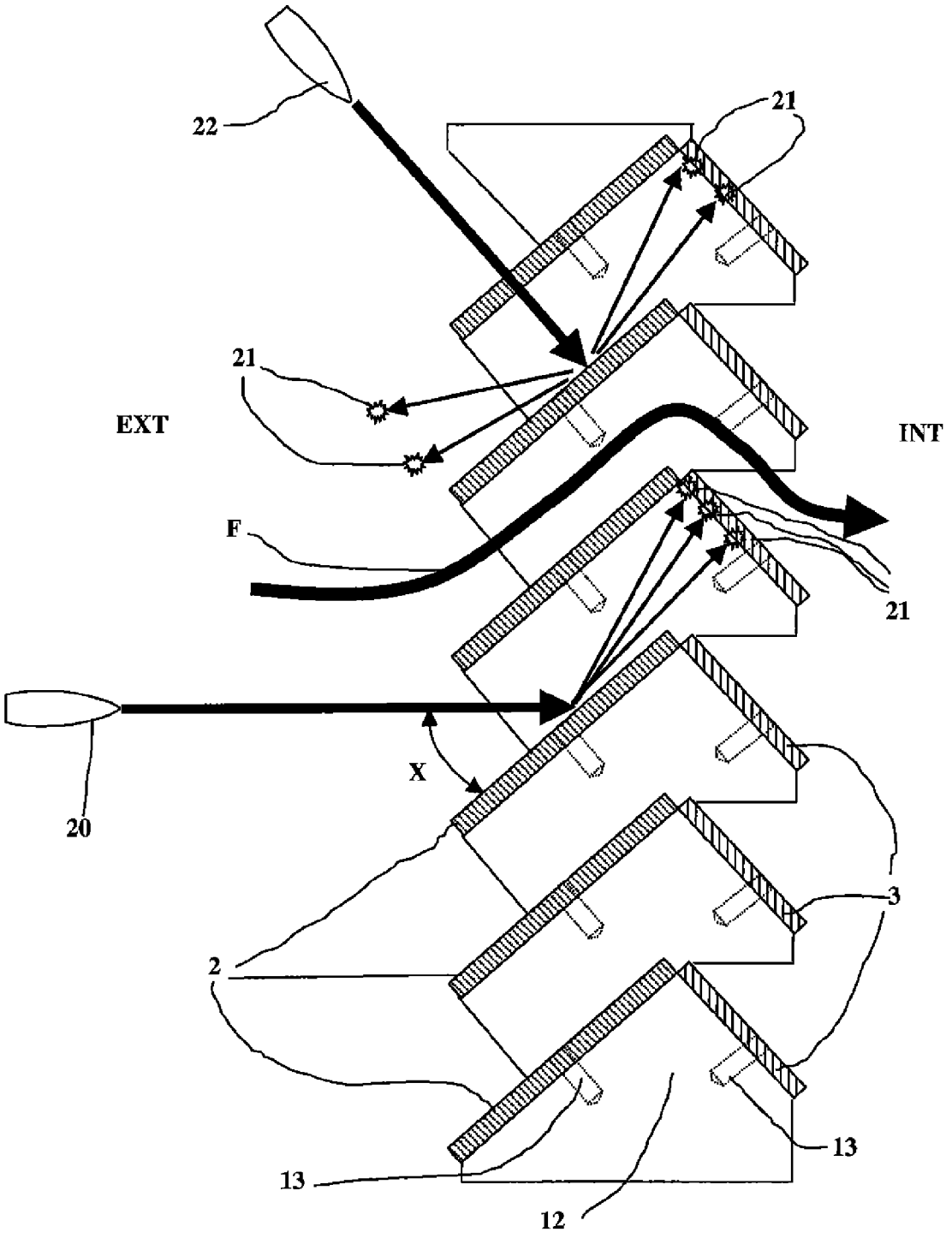
FIG. 3 shows a second cross-sectional view of a grille according to the invention.

Considering a vertical plane P of the grille 1 defined by the outer edges of the outer blades 2, the spacing E between the bars 10 will be selected as large as possible for promoting the passage of the maximum air flow F (flow shown by an arrow in FIG. 3). This spacing E will be limited by the requirement for the bars 10 to overlap, allowing to hide the radiator placed behind the grille 1 on the inner side INT (radiator not shown).

According to the shown embodiment, for a bar 10, the outer blades 2 are wider than the inner blades 3. Each outer blade 2 is made, for example, of an armour steel, namely a steel having a hardness between 350 HBW 1/30/20 and 650 HBW 1/30/20.

The hardness unit (HBW 1/30/20) used is that of the Brinell measurement in which the mark left on the material by a tungsten carbide ball with a diameter of 1 mm, under a load of 294.2 N (30 kg) and maintained for 20 seconds, is measured. The Brinell hardness test is defined by the standard ISO 6506.

Steels with high mechanical properties will be favored, such as defined by the French standard NF-A-36-800-1 such as THD1 according to the standard NF EN 36-801 and 36-802.

Each inner blade 3 is made of a ductile material, namely able to easily deform without breaking. For the inner blades 3, a material more ductile than that of the outer blades 2 will be selected. For example, the inner blades could be made of aluminum 5083, 5086 or 6060 (according to the standards NF EN 485-1; NF EN 755-1; NF EN 755-1) with a hardness between 65 HBW 1/30/20 and 110 HBW 1/30/20. Rubber or synthetic materials (plastic or polymer materials) could also be used.

The thicknesses E1 and E2 of the blades 2 and 3 will be selected according to the threat level, for example, with a thickness of the outer blade 2 E1=5 mm and a thickness of the inner blade 3 E2=8 mm against level 1 threats of STANAG 4569.

A thickness E1 of 8 mm could be selected for the outer blades 2 against level 2 threats (STANAG 4569), while maintaining a thickness E2 of 8 mm for the inner blades 3.

The width L1 of the outer blades is selected taking into account the following constraint:

With respect to the vertical plane P of the grille 1, considering two superimposed successive bars 10*a* and 10*b*, the lowest point 2*a* of the outer blade of the upper bar 10*a* shall be substantially below the highest point 4 of the lower bar 10*b*.

In this manner, as illustrated in FIG. 3, any projectile 20 impacting an outer blade 2 and having a trajectory between the horizontal and an angle lower than the normal to this outer blade 2 will hit the outer blade 2 with an angle of incidence X with respect to this blade 2.

This will cause the fragmentation of the projectile 20 into multiple fragments 21 having a kinetic energy lower than that of the projectile. When the firing is perpendicular to an outer blade 2, the latter is likely to be pierced but the arrangement of the outer blades 2, as stated above, ensures the presence of at least one second outer blade 2 on the trajectory of the projectile 22. This second blade will cause the fragmentation of the projectile 22 already weakened by the stresses it sustained upon piercing the previous outer blade 2.

The inner blades 3 have a function of trapping fragments 21 due to the ductile nature of the material they are made of Thus, any fragment 21 generated by the fragmentation of a projectile 20 or 22 on an outer blade 2 will be trapped in an inner blade 3.

According to FIG. 2, each inner blade 3 should have a width at least equal to the width E of the channel placed facing this inner blade 3 and defined by two successive outer blades 2.

Thus, this inner blade 3 will be capable of stopping all fragments spreading between the outer blades 2 forming the channel.

Figure 4:
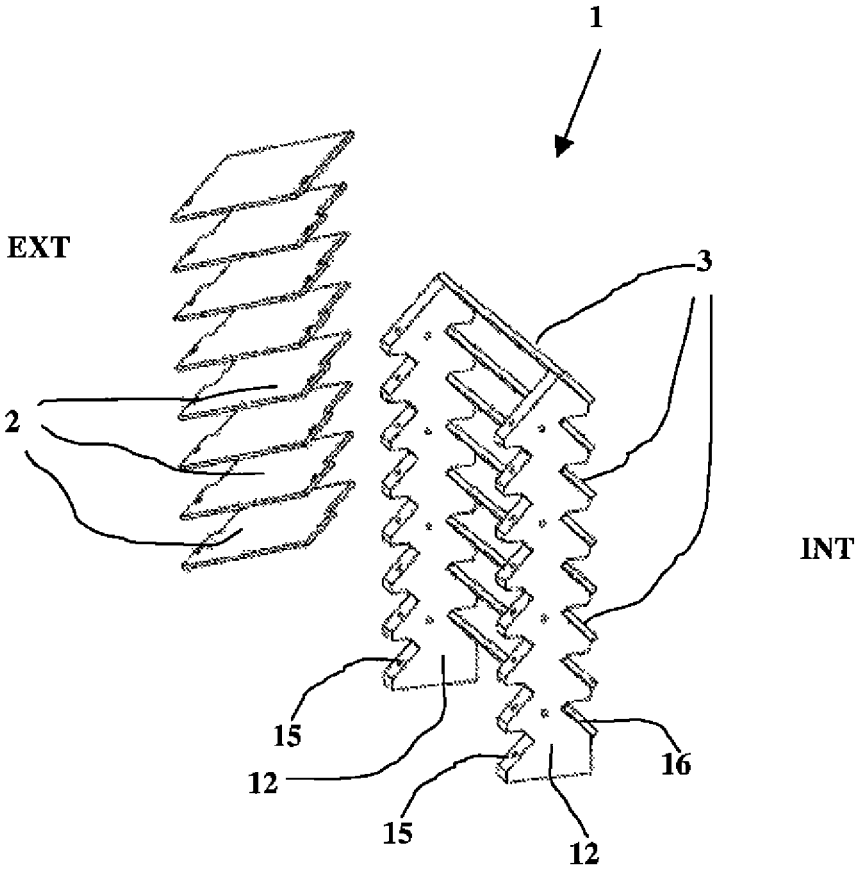
FIG. 4 shows a three-quarter partial view of a grille according to the invention.

According to FIG. 4, the bars 10 are secured to each other by means of vertical spars 12. Each blade 2 or 3 is applied on bearing surfaces 15 and 16 of the spars 12 (also visible in FIG. 2).

Securing each blade 2 and 3 and the spars 12 will be preferentially performed by a removable means such as screws 13 (only the axis of which is shown). In this way, only the blades 2 and 3 which are damaged can be easily replaced.

The removability of the blades 2 and 3 also allows to easily implement on the grille 1 the blades 2 and 3 having a nature and a thickness appropriate for the threat level.

It is thus possible to lighten the grille 1 when the threat level is low, by employing thinner, outer blades 2. Employing inner blades 3 made of aluminum also contributes to lightening the grille 1.

Still according to FIG. 4, each spar 12 comprises two series of inclined bearing surfaces 15 and 16, one oriented toward the exterior of the grille 1 and the other toward the interior, and each intended to receive the end of a blade 2 or 3.

According to a preferred embodiment, the inclined bearing surfaces 15 receiving the outer blades 2 are all inclined at an angle $\alpha$ of 45° with respect to the plane P of the grille 1 so as to obtain an equivalent inclination of the outer blades 2.

The inclined bearing surfaces 16 receiving the inner blades 3 are inclined with respect to the plane P so that the inner blades 3 are perpendicular to the outer blades 2.

Thus, the grille 1 according to the invention always opposes at least one blade 2 or 3 to any firing trajectory. It provides its protection effect regardless of the firing angle, from low angle fire to the horizontal as required by STANAG 4569.

The invention claimed is:

1. An armoured ventilation grille for an opening, said grille comprising an outer side intended to be exposed to a projectile firing and an inner side intended to be applied on the opening, said grille comprising a plurality of bars parallel to each other, the bars having a V-shaped section, each arm of the V being constituted by a blade, said blades being arranged in chevrons in order to form baffles such that at least one blade is on the trajectory of the projectile firing regardless of its incidence, each bar comprising a so-called outer blade and a so-called inner blade, the outer blades forming the outer side of the grille and the inner blades forming the inner side of the grille, wherein the outer blades are made of an armour material while the inner blades are made of a ductile material, the blades being all removably fixed to transverse spars at bearing surfaces.

2. The grille according to claim 1, wherein the outer blades are made of armour steel.

3. The grille according to claim 1, wherein the inner blades are made of aluminum.

4. The grille according to claim 1, wherein the inner blades have a width at least equal to the width of a channel formed by two consecutive outer blades.

5. The grille according to claim 1, wherein the outer blades are inclined at 45 degrees with respect to a plane of the grille defined by the outer edges of the outer blades.

6. The grille according to claim 5, wherein the inner blades are perpendicular to the outer blades.

* * * * *